United States Patent [19]

Mortenson

[11] 3,987,969

[45] Oct. 26, 1976

[54] METHOD AND DISC MILL FOR GRINDING OF MATERIAL

[75] Inventor: Magne Mortenson, Trondheim, Norway

[73] Assignee: Kvaerner Brug A/S, Oslo, Norway

[22] Filed: Mar. 10, 1975

[21] Appl. No.: 557,176

[52] U.S. Cl. ..... 241/30; 241/176

[51] Int. Cl.[2] ..... B02C 17/10

[58] Field of Search ..... 241/30, 172, 176, 178

[56] References Cited

UNITED STATES PATENTS

| | | | |
|---|---|---|---|
| 178,564 | 6/1876 | Smith | 241/178 |
| 478,252 | 7/1892 | Cullingworth | 241/178 X |
| 810,904 | 1/1906 | Bonvillain | 241/172 |
| 1,363,990 | 12/1920 | Morthland | 241/176 |
| 2,014,640 | 9/1935 | Wales | 241/172 |
| 2,482,740 | 9/1949 | Brown | 241/176 X |

*Primary Examiner*—Granville Y. Custer, Jr.
*Attorney, Agent, or Firm*—Young & Thompson

[57] ABSTRACT

A method of grinding material in a disc mill, the mill being operated at maximum r.p.m. corresponding to three to four times the critical velocity and is restricted only by injurious vibrations due to unbalanced masses so that the grinding material is centrifuged and forms a layer on the internal surface of the mill cylinder, the thickness of this layer being restricted by a suitable member. A disc mill for carrying out the method is also disclosed, the mill having free grinding discs of the same diameter, equal to about two thirds of the diameter of the mill cylinder, the discs being collected in an effective grinding area with a length about two thirds of the diameter of the cylinder.

5 Claims, 2 Drawing Figures

METHOD AND DISC MILL FOR GRINDING OF MATERIAL

For almost a hundred years, work has been carried out on the construction of disc mills. None of the many proposals protected by patent has been used in practice, however. This is due to the fact that these mill constructions have not been particularly utilizable nor have they offered much competition to ball mills. The reason for this is that the constructors have not understood the special properties of the disc mill. It seems obvious to point out that analogical conclusions from construction and operation of ball mills would lead to disc mill constructions which are not particularly effective.

By investigation, a number of previously unknown factors have been discovered. On this basis, a special disc mill having great crushing effect has been constructed.

In order to achieve a simple characteristic and comparison of mills of various diameters and various r.p.m.'s, it is reasonable to indicate the r.p.m. of the mill in relation to the position assumed by the material in the mill drum under the influence of centrifugal force. If D signifies the internal diameter of a horizontally mounted cylinder rotating with an r.p.m. of $n$, a centrifuging of particles within the drum will take place, in accordance with the known formula $$a = \frac{\pi^2 n^2 D}{1800}$$

in which $a$ is acceleration, $n$ is r.p.m., and D is the mill drum diameter in meters. Thus, when $a$ is the acceleration of gravity, or 9.81m/sec.$^2$, then the particles are carried with the cylinder, and do not fall, when $n_K$ is greater than $42.2/\sqrt{D}$. Vertically positioned, freely operating discs will not be centrifuged and carried with the cylinder, however, regardless of the r.p.m. thereof.

In the operation of a disc mill, therefore, there is no maximum, critical r.p.m. corresponding to the said formula which applies only to the ball mill.

If a disc mill is operated at a lower r.p.m. than $n_K$, a greater part of the raw material fed into the cylinder will remain on the inlet side of the discs and pass through without crushing. In such case the mill is not very effective.

If the r.p.m. is increased to above $n_K$, the raw material will be introduced between disc and drum and will be crushed. A substantial part of the material is carried with the disc and is released at the top thereof in a return flow toward the cylinder. With increasing r.p.m., the crushing capability of the mill is greatly increased. Experiments have shown that it is expedient to restrict the r.p.m. of the mill to about three to four times $n_K$, inter alia, on the grounds of vibration of unbalanced masses in a rapidly rotating machine.

If the mill is operated at an r.p.m. greater than $n_K$, a portion of the material particles which have passed between the disc and drum will be centrifuged towards the mill cylinder and form an internal layer therein, and the mill gradually becomes filled with material. If this is to be avoided, the mill must be provided with a suitable member which determines the thickness of centrifuged layers. This can be carried out by means of a scraper or in any suitable manner, for example, high pressure water scavenging. If the thickness of the centrifuged material layer is controlled, the mill achieves a self-constructing wear-lining within the cylinder.

Experiments with disc mill grinding show that it is of great importance for effective grinding that the volume of the raw material within the cylinder for grinding is relatively small. Maximum raw material filling should not be above 15% of the cylinder volume. Great energy of conversion is thereby achieved concentrated on small volume of raw material and subsequent great grinding effect.

In order to operate with small amounts in the mill, the cylinder must ot be appreciably constricted at the outlet opening, otherwise it must be provided with a suitable member for discharging the material. On dry grinding in the mill, suitable air suction means are arranged at the outlet opening. A mill having a centrally arranged outlet for overflow for pulp, as in a conventional ball mill, provides an ineffective grinding process.

If the disc mill is operated with wet grinding, addition of water can be reduced to about 50% of that necessary in a corresponding ball mill. This permits improved grinding condition and energy effect in the disc mill.

The size of the disc in relation to the diameter of the cylinder is of great importance to the grinding effect. Experiments with grinding of special types of raw material show that the disc size can be more than two thirds of the diameter of the cylinder. When using discs of such a diameter, the discs will fill up to 50 to 60% of the cylinder volume.

A mill constructed on these principles should operate in closed circuit with a classifying apparatus which separates the crushed material and returns coarse material for regrinding in the mill. The circulating mass through the mill is great, therefore, in comparison with the raw material addition. An extremely rational grinding process is achieved hereby, distinguished by minimum crushing to below the particle size determined by the classifying apparatus in a closed circuit.

If the mill is operated in open circuit without return, it will yield a selective grinding such that resistant minerals in the raw material are not crushed to a great extent and can, therefore, be separated selectively in a suitable subsequent process.

In addition to crushing of mineral raw material, a disc mill constructed on these principles has proved well adapted for treating a number of industrial products, for example, grinding of batches of tree limbs in cellulose digestion. By means of the disc mill grinding, a fibrous product is produced from the said branches which yields a stronger paper than is yielded by a conventional refining.

If the mill is provided with a series of discs - all of the same diameter, but of various thicknesses - it is possible, by disposing the thickest, i.e. the heaviest disc at the material inlet in the cylinder, to subject the coarse additive material to the greatest crushing load. An expedient crushing process is thereby achieved which is not possible in other mills. This process has been the unattainable aim of mill constructors.

The invention is further explained hereinbelow with reference to an embodiment example illustrated in the diagrammatic FIGS. 1 and 2.

Figure 1:
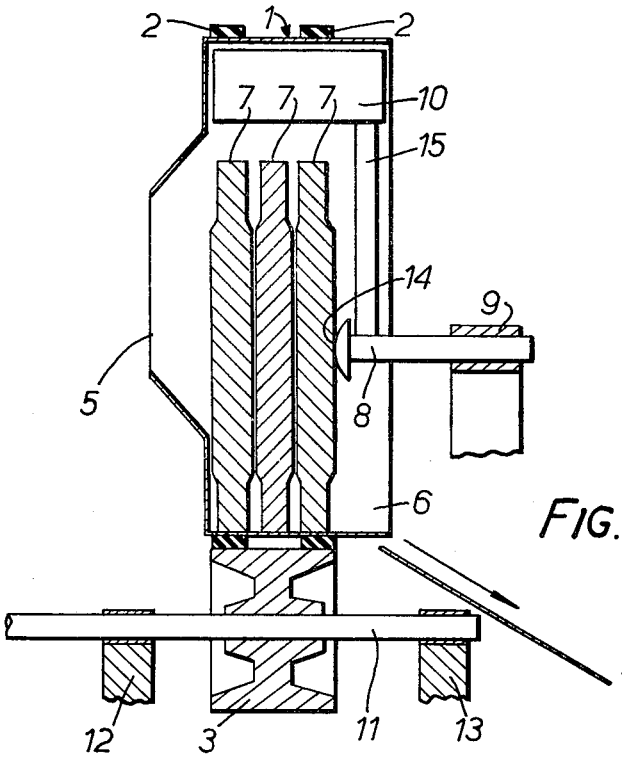
FIG. 1 is a longitudinal section through a disc mill.

The disc mill consists substantially of a mill drum 1, which, on one end side thereof, has a mill inlet 5. The mill drum is rotatably mounted by means of two guide rollers 4 and a support and drive disc 3 which is in frictional operational co-operation with the mill drum, more specifically with two external support bearing rings 2 on the exterior of the mill drum 1. The support and drive disc 3 is mounted on a shaft 11 which, in suitable manner, is mounted in bearings 12, 13 and is connected with drive means (not illustrated).

The right-hand end side of the mill in FIG. 1 is open and forms an outlet 6.

Figure 2:
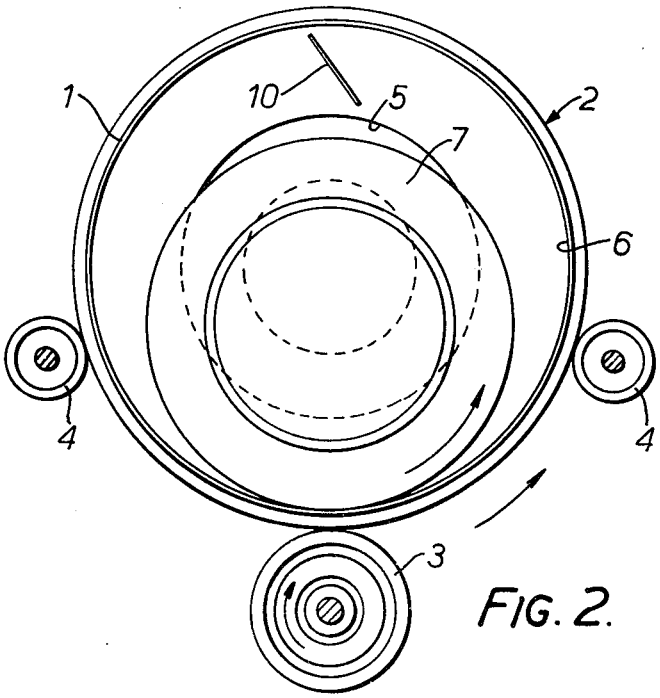
FIG. 2 is an end view with some parts omitted for clarity's sake.

Within the mill drum, three grinding discs 7 are arranged in this case. In a mounting 9, a rod 8 is mounted having a rounded head 14 which acts as guide member for the grinding discs 7. From the rod 8, an arm 15 projects as the support of a scraper 10. In the end view in FIG. 2, the rod 8, arm 15 and mounting 9 are omitted in order to facilitate understanding of the Figure.

In place of the support means 8, 9, 14 the mill can of course be provided with other members, for example, a diaphragm to prevent discharge of the grinding discs. The mill can of course also be mounted and operated in different ways from those illustrated in the drawing.

I claim:

1. A method of grinding material in a disc mill comprising a hollow cylinder and at least one disc in the cylinder, said at least one disc having a diameter that occupies most of the inside diameter of said cylinder, comprising introducing a charge of material to be ground into a said cylinder, rotating the cylinder at a speed such that centrifugal force holds the material in a layer on the inner surface of a wall of the cylinder throughout rotation, and removing a portion only of the thickness of said layer of material after said layer has passed between said wall and said disc.

2. A method as claimed in claim 1, in which said disc has more than two-thirds the diameter of the cylinder and fills up to 50 to 60 percent of the cylinder volume.

3. A disc mill for grinding material, comprising a hollow cylinder having at least one disc therein, the cylinder and disc having horizontal non-coincidental axes, said at least one disc being adapted to rest on the bottom of the inner side wall of the cylinder and having a diameter that occupies most of the inside diameter of said cylinder, an inlet for introducing material to be ground into the cylinder, an outlet for removing ground material from the cylinder, means to rotate the cylinder at a speed at least as great as the speed at which the material clings in a layer by centrifugal force to the inner wall of the cylinder throughout rotation, and means to remove a portion only of the thickness of said layer and to divert ground material from said layer to said outlet.

4. A disc mill as claimed in claim 3, said at least one disc having a diameter about two-thirds the diameter of the cylinder.

5. A disc mill as claimed in claim 3, said at least one disc filling up to 50 to 60 percent of the cylinder volume.

* * * * *